US008945266B2

(12) United States Patent
Yoshimura et al.

(10) Patent No.: US 8,945,266 B2
(45) Date of Patent: Feb. 3, 2015

(54) OIL SEPARATOR

(75) Inventors: Shoji Yoshimura, Hyogo (JP); Michiko Maeda, Takasago (JP); Yasushi Amano, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/296,376

(22) Filed: Nov. 15, 2011

(65) Prior Publication Data

US 2012/0151888 A1 Jun. 21, 2012

(30) Foreign Application Priority Data

Dec. 17, 2010 (JP) ..... 2010-281330

(51) Int. Cl.
*B01D 45/08* (2006.01)
*F25B 43/02* (2006.01)

(52) U.S. Cl.
CPC ..... *F25B 43/02* (2013.01); *F25B 2400/02* (2013.01); *F25B 2500/01* (2013.01)
USPC ..... 55/462; 55/337; 55/447; 55/456; 55/457; 55/459.4

(58) Field of Classification Search
USPC ..... 55/337, 447, 456, 457, 459.4, 462
See application file for complete search history.

(56) References Cited

U.S. PATENT DOCUMENTS 1,779,023 A * 10/1930 Waters ..... 55/446
6,156,106 A * 12/2000 Kamata ..... 96/189

FOREIGN PATENT DOCUMENTS

JP 57-127883 8/1982
JP 2002-143617 5/2002
JP 2004-52710 A 2/2004
JP 2010-260026 A 11/2010

OTHER PUBLICATIONS

Office Action issued Apr. 23, 2013 in Japanese Application No. 2010-281330 (With English Translation).
Extended European Search Report issued Apr. 12, 2013 in Patent Application No. 11190465.2.

* cited by examiner

*Primary Examiner* — Dung H Bui
(74) *Attorney, Agent, or Firm* — Oblon, Spivak, McClelland, Maier & Neustadt, L.L.P

(57) ABSTRACT

An oil separator has a container main body and an flow channel. A partition wall member faces the opening of the flow channel and extends along a wall of the container main body. An upper end member seals the space between the upper end of the partition wall member and the container main body. A side end member seals a space between one side end of the partition wall member and the wall of the container main body. A gap between the partition wall member and the wall of the container main body is narrower than an inner diameter of the flow channel and is largest at an open side end. An outer circumference of the partition wall member is longer than half of the inner diameter of the flow channel and shorter than half of the circumferential length of the inner wall of the container main body.

1 Claim, 3 Drawing Sheets

OIL SEPARATOR

BACKGROUND OF THE INVENTION

1. Field of the Invention

The present invention relates to an oil separator, particularly to an oil separator suitable for separating cooling oil from gas discharged from an oil cooling type compressor.

2. Description of the Related Art

In general, in facility using an oil cooling type compressor, an oil separator that blows gas discharged from an oil cooling type compressor into a container so as to inertially separate or centrifugally separate cooling oil contained in the discharged gas is widely used.

Japanese Unexamined Patent Application Publication No. S57(1982)-127883 describes an invention of an oil separator in which a fluid inlet is provided in an upper part of a side wall of a vertical type cylindrical container, a fluid outlet is provided in an upper lid of the cylindrical container, and an oil separation element is provided so as to cover the fluid outlet, wherein an inner cylinder is provided so as to surround the oil separation element, a partition plate seals a space between the cylindrical container and the inner cylinder at a position near the fluid inlet, and a fluid entering the cylindrical container performs circular motion through a flow passage between the cylindrical container and the inner cylinder so as to centrifugally separate cooling oil, enters the interior of the inner cylinder from an inflow port provided in the vicinity of the partition plate, passes through the oil separation element, and flows out of the fluid outlet.

In recent years, in order to improve a maintenance property and to reduce a pressure loss in an oil separator, a small oil separator with a simpler configuration is desired. At the same time, improvement of an oil separation performance is also strongly desired. A heat exchanger (a condenser) of a refrigeration device particularly shows an extremely low heat exchanging performance when a mixed amount of oil exceeds a certain amount. Thus, a sufficient oil separation capability is required for an oil separator provided between an oil cooling type compressor and a heat exchanger (the condenser).

SUMMARY OF THE INVENTION

In consideration of the above problems, an object of the present invention is to provide an oil separator having high oil separation efficiency with a simple and small structure.

In order to solve the above problems, an oil separator according to the present invention includes: a substantially cylindrical container main body; an introduction flow channel that opens into an inner wall of the container main body, and is substantially vertically connected to the container main body; a partition wall member facing the opening of the introduction flow channel and extending along the inner wall of the container main body; an upper end member sealing a space between an upper end of the partition wall member and the inner wall of the container main body; and a side end member sealing a space between one side end of the partition wall member and the inner wall of the container main body, wherein a gap between the partition wall member and the inner wall of the container main body has a width that is not more than an inner diameter of the introduction flow channel, and becomes the maximum at least at an open side end where the side end member is not provided, and wherein length of an outer circumference of the partition wall member in the horizontal direction from a position facing a center of the introduction flow channel to the open side end is longer than a half of the inner diameter of the introduction flow channel and shorter than a half of circumferential length of the inner wall of the container main body.

With such a configuration, the oil separation efficiency can be enhanced.

In the above oil separator, it is preferable that the length of the outer circumference of the partition wall member in the horizontal direction from the position facing the center of the introduction flow channel to the open side end is longer than one sixth of the circumferential length of the inner wall of the container main body and shorter than one third of the circumferential length of the inner wall of the container main body.

In the above oil separator, height of the partition wall member at the open side end may be longer than height thereof at the side end sealed by the side end member.

In the above oil separator, the upper end member may be downwardly inclined from a part of the upper end member above the introduction flow channel toward the open side end of the partition wall member.

In the above oil separator, the partition wall member may be arranged such that the width of the gap between the partition wall member and the inner wall of the container main body becomes the minimum at the side end sealed by the side end member and gradually wider toward the open side.

The present inventors made several samples of oil separators and implemented several experiments, and found that cooling oil mixed into gas discharged from an oil cooling type compressor can be made to be not more than 1,000 ppm by making the width of a gap G between the inner wall of the container main body and the partition wall member be not more than an inner diameter d of the introduction flow channel, and making circumferential length L of the partition wall member in the horizontal direction from the position facing the center of the introduction flow channel to the open side end be longer than a half of the inner diameter of the introduction flow channel (d/2) and shorter than a half of the circumferential length of the inner wall of the container main body ($\pi D/2$).

DESCRIPTION OF THE PREFERRED EMBODIMENTS

Figure 1:
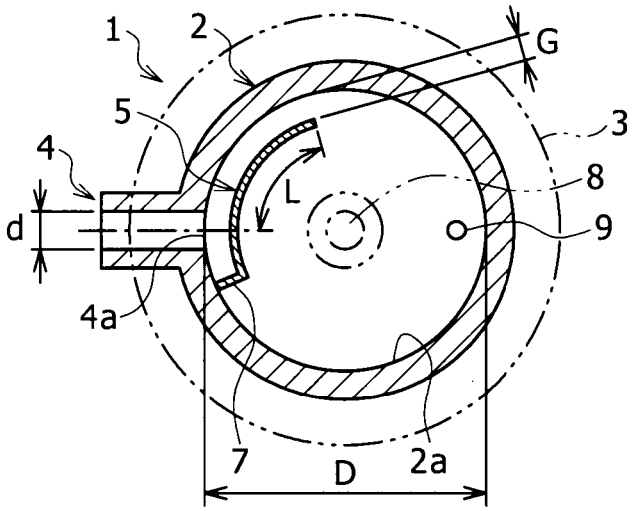
FIG. 1 is a horizontally sectional view of an oil separator of a first embodiment of the present invention.
Figure 2:
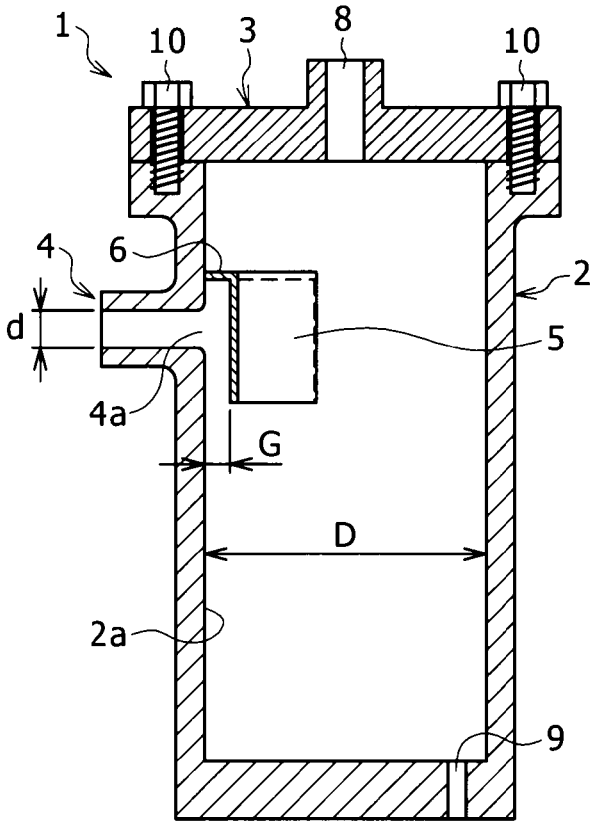
FIG. 2 is a vertically sectional view of the oil separator of FIG. 1.

Hereinafter, embodiments of the present invention will be described with reference to drawings. FIGS. 1 and 2 show an oil separator 1 of a first embodiment of the present invention. The oil separator 1 is mainly used to separate cooling oil from gas discharged from an oil cooling type screw compressor (not shown), and intended to be arranged between the oil cooling type screw compressor and a condenser (a heat exchanger) in a refrigeration device.

The oil separator 1 has a container main body 2 formed into an upright bottomed cylinder shape having a diameter D, and a lid body 3 for sealing an upper end opening of the container main body 2. An introduction flow channel 4, which introduces the discharged gas, is radially disposed on the container main body 2, that is, disposed vertically on a side wall of the container main body 2, and an opening 4*a* having an inner diameter d is formed in an inner wall 2*a* of the container main body 2.

A partition wall member 5 extending along the inner wall 2*a* is arranged in the container main body 2 so as to face the opening 4*a*. The partition wall member 5 is supported relative to the container main body 2 by an upper end member 6 provided so as to seal a space between an upper end of the partition wall member 5 and the inner wall 2*a*, and a side end member 7 provided so as to seal a space between one side end of the partition wall member 5 and the inner wall 2*a*. A gap G having a fixed width not more than the inner diameter d of the opening 4*a* is formed between the partition wall member 5 and the inner wall 2*a*.

The height of the partition wall member 5 is preferably about 4 times more than the inner diameter d. However, the height is not limited to this length but may be appropriately adjusted so as to obtain a sufficient oil separation characteristic.

Positions of the upper end member 6 and the side end member 7, that is, an upper end position and a sealed circumferential side end position of the partition wall member 5, may be appropriately determined in consideration of attachment (welding) of the upper end member 6 and the side end member 7 in the vicinity of the opening 4*a*.

An exhaust port 8 opening in the center direction of the container main body 2 is formed in a center part of the lid body 3. A liquid discharge port 9 for discharging the separated oil is formed in a bottom part of the container main body 2. The lid body 3 is fixed to the container main body 2 with a plurality of bolts 10.

In the oil separator 1 of the present embodiment, the partition wall member 5 covers the opening 4*a* of the introduction flow channel 4, that is, is arranged on an extension line of the introduction flow channel 4 so as to obstruct a way of the gas radially flowing into the container main body 2 from the introduction flow channel 4. Due to this, the partition wall member 5 firstly receives the flow of the gas introduced from the introduction flow channel 4, and inertially separates the cooling oil accompanying the gas, or the cooling oil that flows on a bottom part of the introduction flow channel 4 into the inside of the container main body together with gas. A liquid inertially separated by the partition wall member 5 trickles down along the partition wall member 5 and collected in a lower part of the container main body 2.

Further, once the gas is prevented from flowing by the partition wall member 5, the gas flows along a flow passage, which is formed by the gap between the inner wall 2*a* and the partition wall member 5, in the direction in which the upper end member 6 and the side end member 7 are not provided in the partition wall member 5, that is, toward the open end side of the partition wall member 5 and downward. That is, the gas introduced into the container main body 2 forms a downward spiral stream along the inner wall 2*a*. The cooling oil in the gas is further centrifugally separated by centrifugal force of this spiral stream and attaches to the inner wall 2*a*, trickles down along the inner wall 2*a*, and is collected in the lower part of the container main body 2.

A large number of samples of the present embodiment with various lengths L of an outer circumference of the partition wall member 5 in the horizontal direction from a position facing a center of the introduction flow channel 4 to the open side end were made, and an experiment in which the oil is separated from a coolant discharged from the oil cooling type screw compressor of the refrigeration device was implemented. In this experiment, a separation capability of the oil separator 1 is evaluated by taking a mixed amount of the cooling oil that is contained in the coolant and passes through the oil separator 1 as an indicator.

Figure 3:
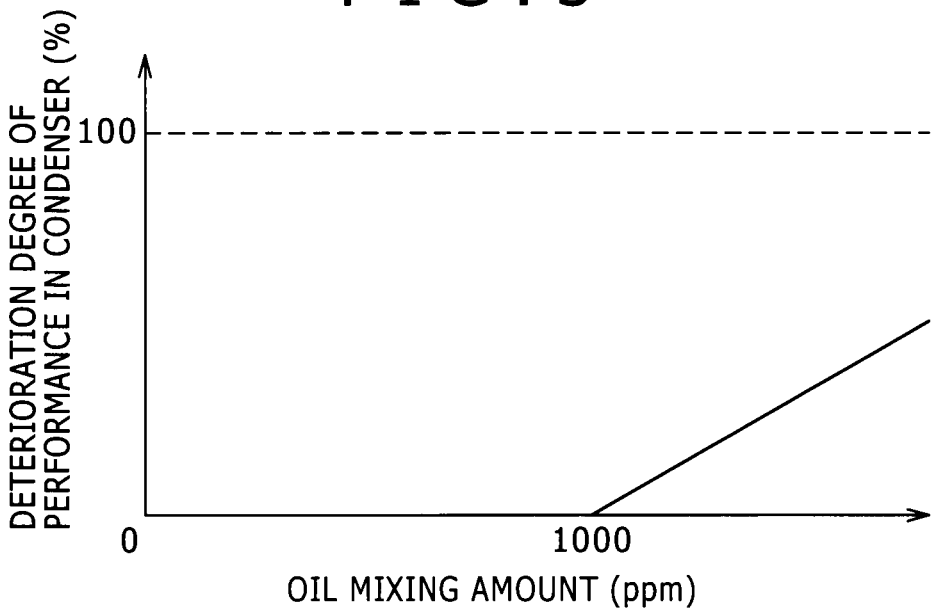
FIG. 3 is a graph showing a relationship between an oil mixed amount and a deterioration degree of a heat exchanging performance in a condenser of a refrigeration device.

As shown in FIG. 3, the condenser positioned downstream of the oil separator 1 shows decrease of a heat exchanging capability when a mixed ratio of the cooling oil exceeds 1,000 ppm. Thus, when the mixed ratio of the cooling oil can be made to be not more than 1,000 ppm, it can be evaluated that the oil separator 1 can exert a sufficient separation capability. It should be noted that a deterioration degree of the heat exchanging capability is indicated by a decrease ratio of thermal conductivity in the condenser. For example, when the thermal conductivity in the condenser is 90% of a thermal conductivity that is obtained when cooling oil is not contained in coolant at all, the deterioration degree is 10%.

Figure 4:
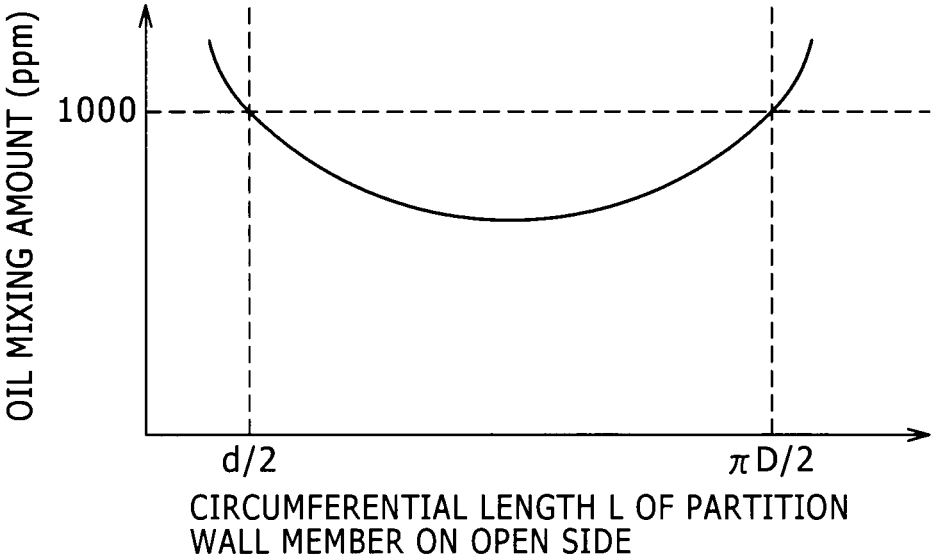
FIG. 4 is a graph showing a relationship between length of a partition wall member on one side of the oil separator of FIG. 1 and an amount of oil that is not separated and remains.

As shown in FIG. 4, it is confirmed that when the circumferential length L of the partition wall member 5 in the horizontal direction from the position facing the center of the introduction flow channel 4 to the open side end is longer than a half of the inner diameter d (d/2) of the introduction flow channel 4 and shorter than a half of the circumferential length of the inner wall ($\pi D/2$) of the container main body 2, the mixed amount of the cooling oil that is contained in the coolant and passes through the oil separator 1 can be made to be not more than 1,000 ppm.

As is clear from FIG. 4, it is more preferable that the above length L is longer than one sixth of the inner diameter d ($\pi D/6$) of the introduction flow channel 4 and shorter than one third of the circumferential length of the inner wall ($\pi D/3$) of the container main body 2. It is further preferable that the above length L is substantially one fourth of the inner diameter d ($\pi D/4$) of the introduction flow channel 4.

As a result of the experiment performed with various gaps G between the partition wall member 5 and the inner wall 2*a* that have various widths, it was confirmed that the effect of separating the cooling oil became lower with the larger width of gap G, however, a substantially constant separation capability could be exerted irrespective of the width of the gap G, when the width of the gap G is not more than the inner diameter d of the introduction flow channel 4.

Figure 5:
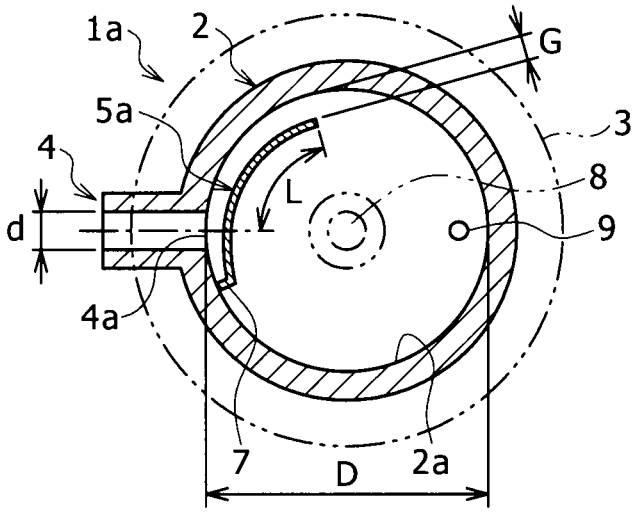
FIG. 5 is a horizontally sectional view of an oil separator of a second embodiment of the present invention.
Figure 6:
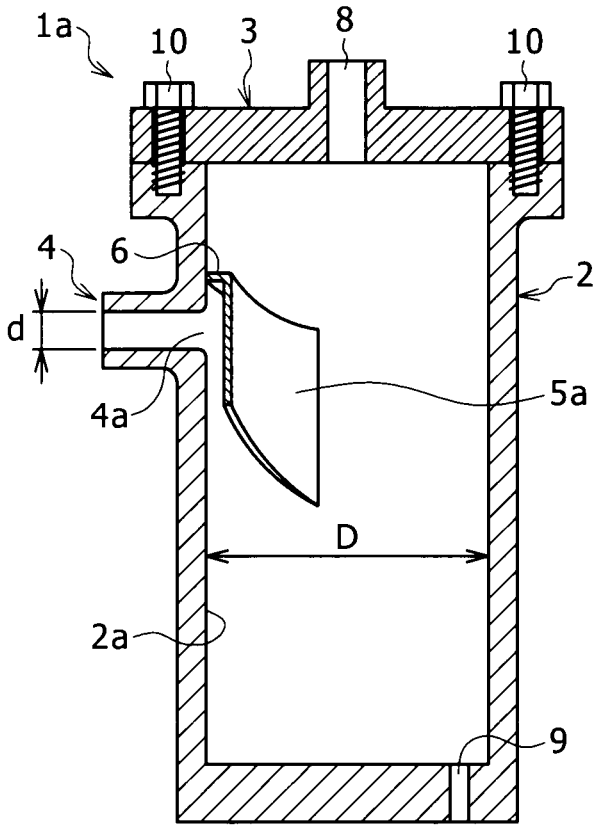
FIG. 6 is a vertically sectional view of the oil separator of FIG. 5.

Next, an oil separator 1*a* of a second embodiment of the present invention is shown in FIGS. 5 and 6. It should be noted that, in the explanation of the present embodiment, the same constituent elements as the first embodiment will be given the same reference numerals, and duplicated description thereof will be omitted.

In the present embodiment, positions of an upper end and lower end of the partition wall member 5 gradually become lower from the side end sealed by the side end member 7 towards the open side, and the upper end member 6 is downwardly inclined from its part above the introduction flow channel 4 toward the open side end of the partition wall member 5. This promotes formation of the downward spiral stream.

Further, in the partition wall member 5, the height of the open side end is longer than the height of the side end sealed by the side end member 7. Since gas is more diffused on downstream side of the stream and flow width of the stream becomes wider, the above shape is intended to sufficiently guide the stream and form the spiral stream.

The present embodiment has both the characteristic that the positions of the upper end and lower end of the partition wall member 5 gradually become lower from the side end sealed by the side end member 7 towards the open side, and the characteristic that the height of the open side end of the partition wall member 5 is longer than the height of the sealed side end thereof. However, the present embodiment may have any one of the characteristics. Even such an embodiment promotes the formation of the downward spiral stream.

The partition wall member 5 of the present embodiment is arranged such that the width of the gap between the partition wall member 5 and the inner wall 2*a* of the container main body 2 becomes the minimum at the side end sealed by the side end member 7 and becomes gradually wider toward the open side end. This is because the gas easily flows in the direction in which the width of the gap becomes wider, and the formation of the spiral stream in the intended circular direction becomes easier. At this time, a maximum value of the width of the gap between the partition wall member 5 and the inner wall 2*a*, that is, the width of the gap G in the open side end may be made to be not more than the inner diameter d of the introduction flow channel 4.

What is claimed is:

1. An oil separator, comprising:

a substantially cylindrical container main body;

an introduction flow channel having an opening into an inner wall of said container main body, and that is substantially vertically connected to said container main body;

a partition wall member facing said opening of said introduction flow channel and extending along said inner wall of said container main body;

an upper end member sealing a space between an upper end of said partition wall member and said inner wall of said container main body; and a side end member sealing a space between a first side end of said partition wall member and said inner wall of said container main body, the first side end being closer to the opening of the introduction flow channel than a second side end of said partition wall member opposite the first side end, wherein said second side end of said partition wall member is open with respect to said container main body, wherein a lower end of said partition wall member, which is opposite the upper end, is open with respect to said container main body, wherein a gap between said partition wall member and said inner wall of said container main body has a width that is not more than an inner diameter of said introduction flow channel, the width of said gap being at a maximum at least at said second side end which is open with respect to said container main body, wherein a length of an outer circumference of said partition wall member in a horizontal direction from a position facing a center of said introduction flow channel to the open side end is longer than a half of the inner diameter of said introduction flow channel and shorter than a half of a circumferential length of said inner wall of said container main body, wherein said partition wall member is arranged such that the width of said gap between said partition wall member and said inner wall of said container main body is at a minimum at the side end sealed by said side end member and is gradually wider toward the open side end, wherein the length of the outer circumference of said partition wall member in the horizontal direction from the position facing the center of said introduction flow channel to the open side end is longer than one sixth of the circumferential length of said inner wall of said container main body and shorter than one third of the circumferential length of said inner wall of said container main body, wherein a vertical length of said partition wall member at the open side end is longer than a vertical length of said partition wall member at the side end sealed by said side end member, and wherein said upper end member is downwardly inclined from a part of said upper end member above said introduction flow channel toward the open side end of said partition wall member.

* * * * *